US008066175B2

(12) United States Patent
Nieto

(10) Patent No.: US 8,066,175 B2
(45) Date of Patent: Nov. 29, 2011

(54) CONTAINER FOR FOOD, ESPECIALLY TOSTADAS

(75) Inventor: Ismael Palacios Nieto, Nuevo Leon (MX)

(73) Assignee: Grupo Fiesta Charra, S.A. DE C.V., Monterrey, Nuevo Leon (MX)

( * ) Notice: Subject to any disclaimer, the term of this patent is extended or adjusted under 35 U.S.C. 154(b) by 18 days.

(21) Appl. No.: 12/461,486

(22) Filed: Aug. 13, 2009

(65) Prior Publication Data

US 2010/0206943 A1 Aug. 19, 2010

(30) Foreign Application Priority Data

Feb. 13, 2009 (MX) ..... MX/U/2009/000040

(51) Int. Cl.
*B65D 5/10* (2006.01)

(52) U.S. Cl. ..... 229/109; 229/128; 229/138; 229/156; 229/160.2

(58) Field of Classification Search ..... 229/109, 229/116.1, 138, 155, 156, 160.2, 128
See application file for complete search history.

(56) References Cited

U.S. PATENT DOCUMENTS

| | | | | | |
|---|---|---|---|---|---|
| 901,695 | A * | 10/1908 | Davis | 229/162.7 |
| 2,047,804 | A * | 7/1936 | Shapiro | 229/138 |
| 2,091,291 | A * | 8/1937 | Ringler | 229/109 |
| 2,160,488 | A * | 5/1939 | Ringler | 229/108 |
| 3,549,081 | A * | 12/1970 | Nelson | 229/117 |
| 3,768,720 | A * | 10/1973 | Bundy | 229/117.25 |
| 4,185,767 | A * | 1/1980 | Sykora et al. | 229/138 |
| 4,442,624 | A * | 4/1984 | Browne | 43/107 |
| 4,850,528 | A * | 7/1989 | Hanus | 229/138 |
| 5,558,272 | A * | 9/1996 | Magister | 229/109 |
| 5,676,306 | A * | 10/1997 | Lankin et al. | 229/404 |
| 7,434,721 | B2 * | 10/2008 | Feltz | 229/109 |

* cited by examiner

*Primary Examiner* — Gary Elkins
(74) *Attorney, Agent, or Firm* — Breiner & Breiner, L.L.C.

(57) ABSTRACT

A container for food, such as used for the storage or packaging of tostadas, manufactured as a carton, which is formed with eight sections or sides that are joined by adhesive at an edge to fold the container is disclosed. The container also has edges placed on the top and bottom ends that, when interwoven towards the center of the container, permit the formation of a kind of bow with which the container is kept closed. In order to open the container, it is only necessary to pull outwards on opening projections which are part of the bow. Likewise, and as a consequence of the interweaving of the edges, an internal pulling acts as a muffling, thereby helping the food, e.g., tostadas, to be maintained in a good state, without being broken.

4 Claims, 3 Drawing Sheets

CONTAINER FOR FOOD, ESPECIALLY TOSTADAS

FIELD OF THE INVENTION

The present invention is a container for food, such as useful for the storage or packaging of tostadas, manufactured as a carton, which is formed with eight sections or sides that are joined at an end by means of glue or the like upon folding the container. The container also has edges placed on the top and bottom ends of the container which when interwoven towards the center of the container, permit the formation of a kind of bow, with which the container is kept closed. In order to open the container, it is only necessary to pull outwards on an opening projection or strip.

BACKGROUND OF THE INVENTION

Currently, there exists many containers which keep and hold food to be sold to the public. The containers for tostadas are generally plastic bags, that have the disadvantage that the product is often broken, consequently preventing their sale to the public, having as a result losses for the manufacturer. Taking into account the above, the plastic bags are designed in a way in which consumers cannot see the contents thereof. This is a reason why the consumer does not observe that the tostadas, in the majority of the cases, are broken.

The container of the invention avoids the totality of the disadvantages set forth above due to the security with which the container is opened and closed, as well as due to the ease of stacking and packing the container. In this way, the product is not broken. Moreover, a consumer can easily see the contents of the container as well as extract the pieces that are desired to be taken out.

SUMMARY OF THE INVENTION

The container of the present invention has a new package which is octagonal, and it is the only one in the tostada market area that has a particular closure in which each of the eight sides of the box is joined from its top and bottom ends to form a kind of bow. This makes the container more attractive and easy to open and close. Additionally, this closure helps to keep the tostadas fresh and crunchy for a longer time. Likewise, this closure does not require any sealing for closing the container.

The bottom end of the container keeps the eight above mentioned sides closed and pushed together, with the only difference between opening and closing being that at the time the sides are put together, such provokes an internal pull. At the moment of carrying out the closing, it has been concluded that it serves as a muffling for the tostadas, since it is much more difficult to have the tostadas break whenever they are hit. This is very different from those boxes that keep the bottom end flat.

The container also includes a window through which the consumer can appreciate and view the contents of the box. This window is of a sufficiently large size to permit the adequate observation of the state of the tostadas, contrary to the packages that exist in the market that use a small window so that the consumer will not become aware of the broken tostadas at the bottom of the package. Also, there are times that some of the manufacturers darken the color of the window to confuse the consumer.

The container uses one single contact on one side, thereby providing assembly which is very easy and practical, as well as its storage.

Among other advantages that the present invention has, is the one of using a smaller percentage of carton than any other type of box for tostadas in the market. Since the closing area of the containers require to be only a little bit longer than the radius of the formed box, whenever two of these closures get together on opposite sides, the diameter of the lid is covered.

It is then the object of the present invention to provide a container for food, especially tostadas, designed to provide the following:

(a) To protect the product;

(b) To transport the product in a secure way and to prevent the contents from being broken or damaged;

(c) To have the tostadas be kept whole for a longer time, since the diameter and the height of the container are especially designed for this and similar products;

(d) To close and open the package, as well as to take out a desired number of products in a secure manner;

(e) To observe the state in which the tostadas are present; and (f) To be more economical, thereby permitting offering the consuming public a better price in the final product.

DESCRIPTION OF THE DRAWINGS

The unique details of the present invention are clearly shown in the following description and in the drawings attached, the same reference numbers being used to indicate the same parts of the figures.

DETAILED DESCRIPTION OF THE PREFERRED EMBODIMENTS

Figure 2:
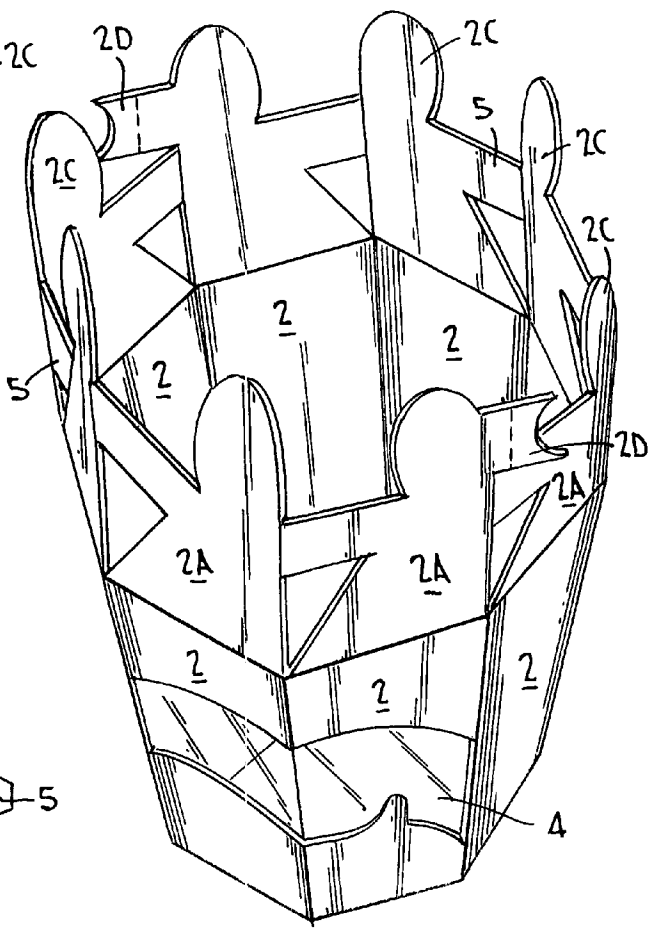
FIG. 2 shows a perspective view of the folded container open on its top part.
Figure 1:
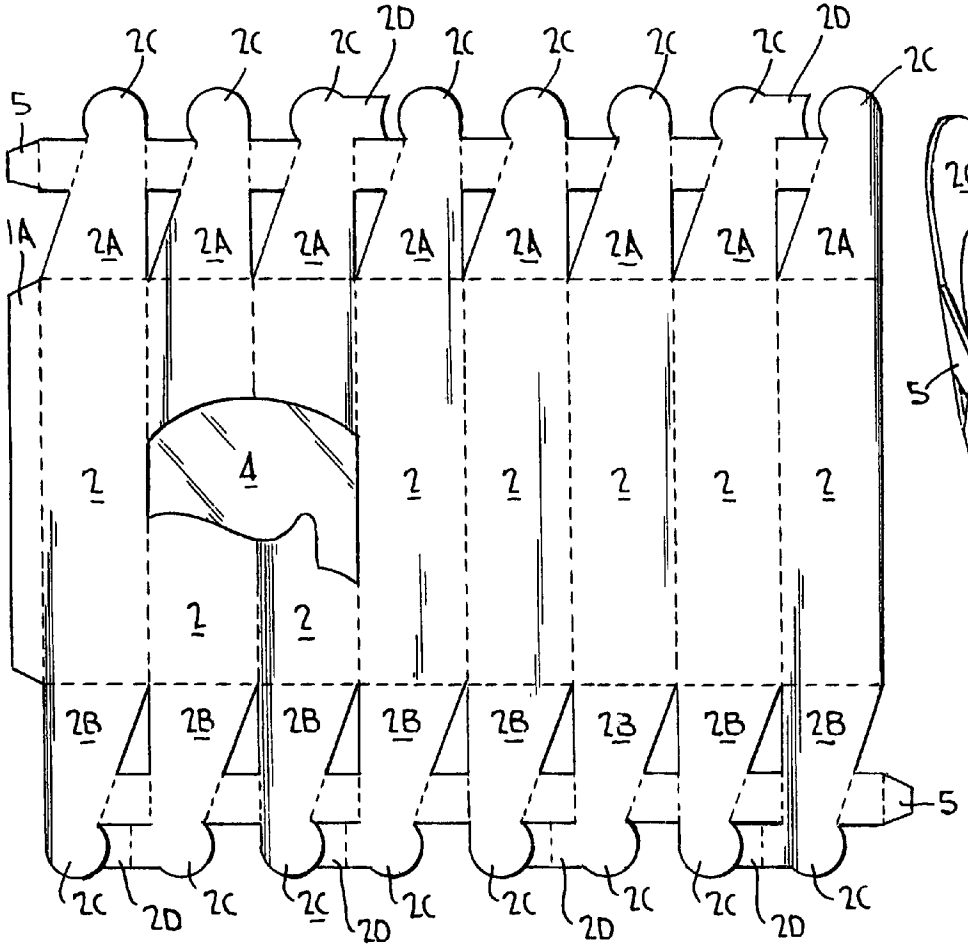
FIG. 1 shows a plan view of the container before it is folded.
Figure 4:
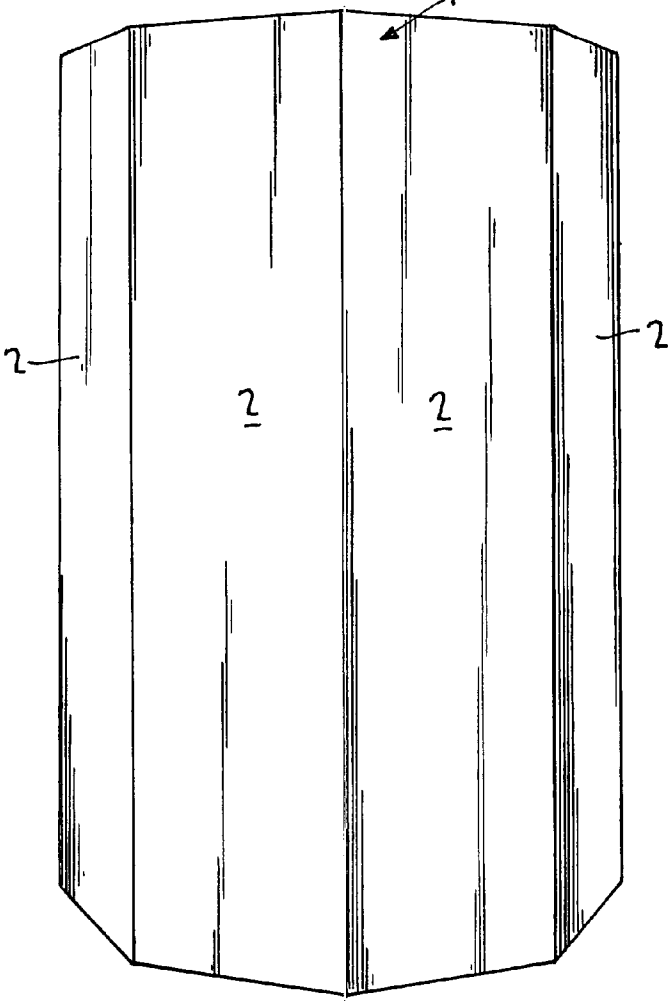
FIG. 4 shows a posterior elevated view of the folded container.
Figure 3:
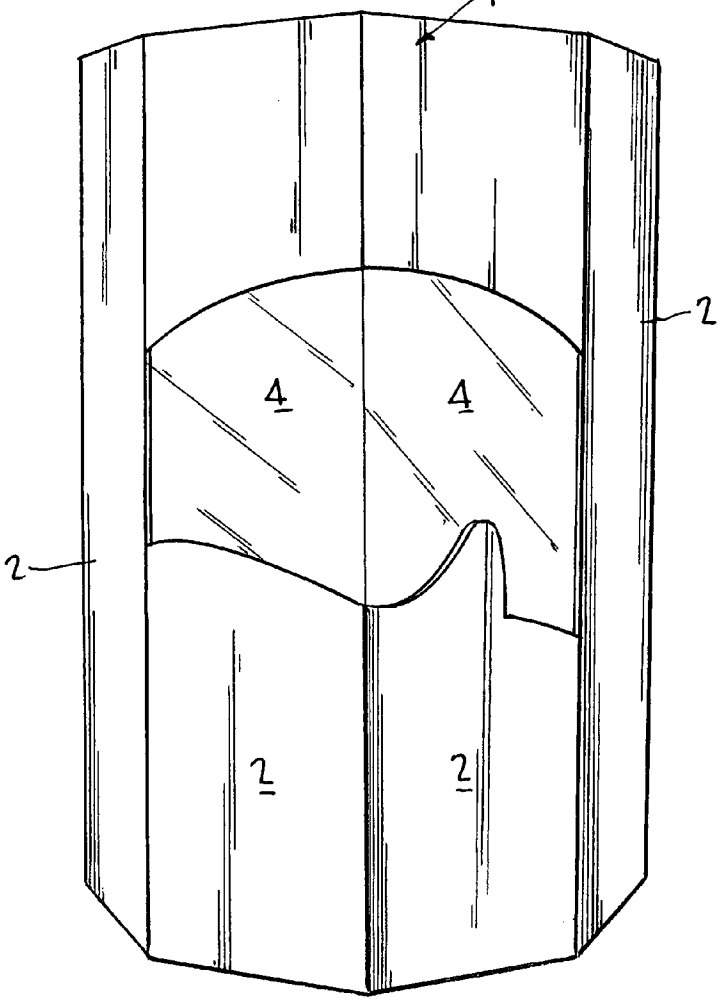
FIG. 3 shows a frontal elevated view of the folded container.
Figure 5:
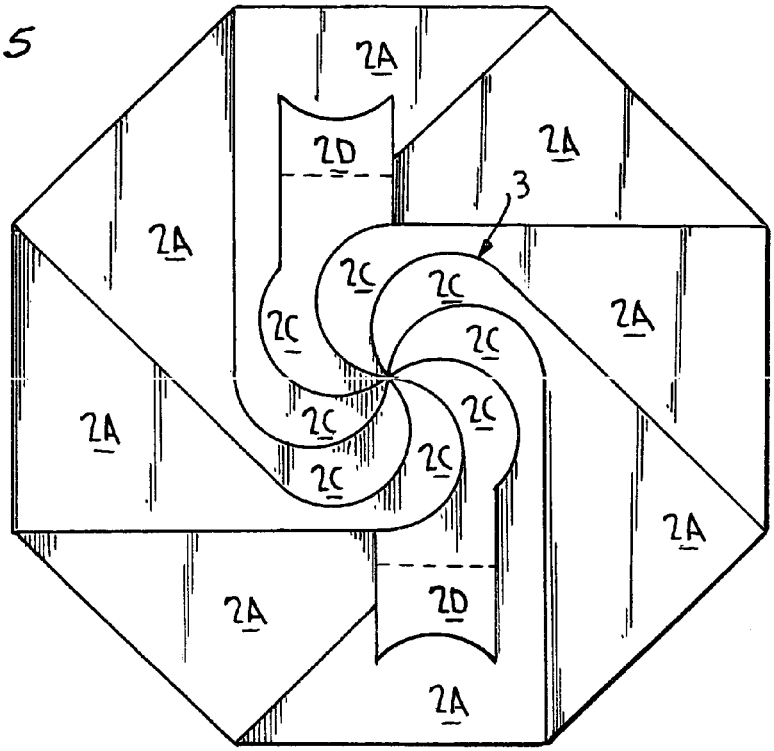
FIG. 5 shows a top view of the closed container.
Figure 6:
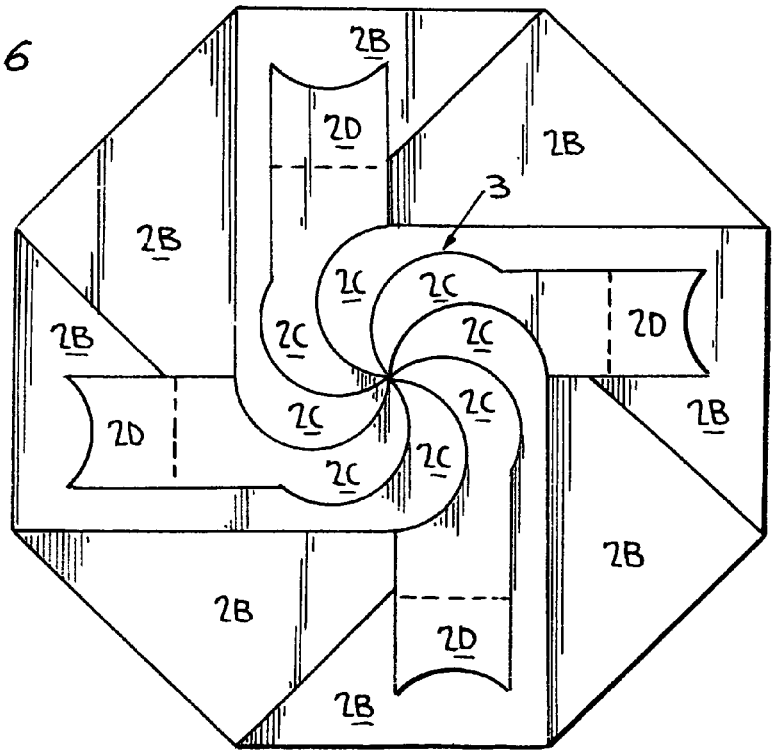
FIG. 6 shows a bottom view of the closed container.

Regarding such figures, the container of the present invention has a body (1) which is formed in 8 sections or sides (2) joined on its ends by suspenders or bands (5). The container is formed by joining an edge (1A) from one of the sections, with the section of the opposite side, by means of glue or any other appropriate material. Likewise, the top band as well as the bottom band (5) are joined by means of glue with the opposite ends of the top end section (2A) and the bottom end section (2B), folding in this way the top and bottom parts of the container.

The eight sections (2) on their top sections (2A) and bottom sections (2B) have in addition, projections or edges (2C) which are interwoven in the center of the container forming a kind of bow (3), with which the container is closed without requiring any type of glue. In order to open the container, it would only be necessary to pull outwards the opening strips (2D), thereby allowing a consumer to take out as much of the product that is needed.

When interweaving the projections or edges (2C) of the top end sections (2A) and bottom end sections (2B) of the container, upon closing, provokes an internal pulling, that serves as a muffling to avoid having the material within the container, e.g., the tostadas, be broken, contrary to boxes that have a flat second end.

The container also has in a middle or central part of two of the eight sections (2), an opening (4) that acts as a window, in order to allow the consumer to observe the state of the contents of the container.

The present invention is a container for food, such as used for the storage or packaging of tostadas, manufactured as a carton, which is formed with eight sections or sides that are joined by means of adhesive through an edge to fold the container. The container also has edges placed on the top and bottom ends that, when interwoven towards the center of the container, permit the formation of a kind of bow, with which the container is kept closed. In order to open the container, it is only necessary to pull outwards on the opening projections (2D). Likewise, and as a consequence of the interweaving of the edges, such closure provokes an internal pulling that acts as a muffling, helping the tostadas to be kept in a good state, and keeping them from being broken.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A container for holding and storing food comprising:

an octagonal body including eight wall sections, wherein each of said eight wall sections has a top edge, a bottom edge and a longitudinal edge and wherein first and last sections of said eight wall sections are joined to each other upon folding and forming of the body of the container;

each of the eight wall sections having a projecting end at a top end and a bottom end thereof, each projecting end at the top end being connected together by a first band and each projecting end at the bottom end being connected together by a second band, each of said projecting ends being unconnected to an adjacent one of said projecting ends between a respective one of said bands and a respective one of said wall sections;

an edge operatively positioned on each said top end and each said bottom end of the eight wall sections, wherein each said edge of each said top end is constructed and arranged to be interwoven with each other in a center of the top end of the container when constructed to form a bow which closes the top end of the container and wherein each said edge of each said bottom end is constructed and arranged to be interwoven with each other in a center of the bottom end of the container when constructed to form a bow which serves to close the bottom end of the container; and at least one opening projection strip operatively positioned on at least one of the edges, wherein the opening projection strip enables opening of the container upon pulling the opening projection strip outwards.

2. The container according to claim 1, wherein a window is provided in a central area of two of the eight wall sections.

3. The container according to claim 1, wherein said bow in the top end is provided in absence of adhesive and allows the container to be opened and closed repeatedly.

4. The container according to claim 1, wherein when the edges are interwoven towards the center of the container to form the bow, an internal pulling is created in the container which serves as a muffling to keep food in said container in an unbroken state.

* * * * *